US011761245B2

(12) United States Patent
Booth

(10) Patent No.: US 11,761,245 B2
(45) Date of Patent: Sep. 19, 2023

(54) DOOR LOCK SYSTEM

(71) Applicant: Penco Products, Inc., Greenville, NC (US)

(72) Inventor: Kevin Everett Booth, Mapleton, UT (US)

( * ) Notice: Subject to any disclaimer, the term of this patent is extended or adjusted under 35 U.S.C. 154(b) by 410 days.

(21) Appl. No.: 17/159,439

(22) Filed: Jan. 27, 2021

(65) Prior Publication Data

US 2022/0235581 A1 Jul. 28, 2022

(51) Int. Cl.

| | |
|---|---|
| ***E05B 63/14*** | (2006.01) |
| ***E05B 65/44*** | (2006.01) |
| ***E05B 35/08*** | (2006.01) |
| ***E05B 65/00*** | (2006.01) |
| ***E05B 65/462*** | (2017.01) |

(52) U.S. Cl.

CPC ..... *E05B 63/14* (2013.01); *E05B 35/08* (2013.01); *E05B 63/143* (2013.01); *E05B 65/0003* (2013.01); *E05B 65/44* (2013.01); *E05B 65/462* (2013.01); *E05B 65/0017* (2013.01)

(58) Field of Classification Search

CPC ..... E05B 35/08; E05B 63/14; E05B 63/143; E05B 65/0003; E05B 65/0017; E05B 65/44; E05B 65/462; E05B 65/465; E05B 65/468

See application file for complete search history.

(56) References Cited

U.S. PATENT DOCUMENTS

| | | | | | |
|---|---|---|---|---|---|
| 1,033,793 | A * | 7/1912 | Geraty | E05B 65/462 | 312/217 |
| 2,992,056 | A * | 7/1961 | Thielker | E05B 65/465 | 312/221 |
| 3,150,902 | A * | 9/1964 | Naab | E05B 65/462 | 312/289 |
| 3,774,985 | A * | 11/1973 | Chovanec | E05B 65/462 | 312/217 |
| 3,791,708 | A * | 2/1974 | Signore | E05B 65/462 | 312/221 |
| 3,976,343 | A * | 8/1976 | Breckner | E05B 65/462 | 312/219 |
| 5,257,860 | A * | 11/1993 | Slivon | E05B 65/462 | 312/219 |
| 6,116,067 | A * | 9/2000 | Myers | E05B 65/462 | 70/279.1 |
| 7,258,373 | B2 * | 8/2007 | Plett | E05B 83/16 | 292/216 |
| 8,661,862 | B2 * | 3/2014 | Mikolajczyk | E05B 63/14 | 70/79 |
| 9,850,687 | B2 * | 12/2017 | Roatis | E05B 65/462 | |
| 2002/0165641 | A1 * | 11/2002 | Manalang | E05B 65/462 | 312/1 |

* cited by examiner

*Primary Examiner* — Christopher J Boswell
(74) *Attorney, Agent, or Firm* — Benesch, Friedlander, Coplan & Aronoff, LLP

(57) ABSTRACT

A door lock system includes a shaft and a cam. The cam is supported on the shaft for rotation with the shaft, and for movement along the shaft throughout a range of door lock release locations. A selector engages the cam to move the cam along the shaft upon rotation of the selector. An actuator lock has a closed condition blocking rotation of the shaft, and has an open condition permitting rotation of the shaft. The actuator lock prevents rotation of the cam at any of the door lock release locations when the actuator lock is in the closed condition.

20 Claims, 4 Drawing Sheets

DOOR LOCK SYSTEM

TECHNICAL FIELD

This technology includes door locks for storage lockers.

BACKGROUND

Storage lockers may be arranged together in a cabinet. Each locker in the cabinet has a door with an individual lock that typically is operated independently of the locks at the other doors.

SUMMARY

In a given example, a door lock system includes a shaft and a cam. The cam is supported on the shaft for rotation with the shaft, and for movement along the shaft throughout a range of door lock release locations. A selector engages the cam to move the cam along the shaft upon rotation of the selector. An actuator lock has a closed condition blocking rotation of the shaft, and has an open condition permitting rotation of the shaft. The actuator lock prevents rotation of the cam at any of the door lock release locations when the actuator lock is in the closed condition.

The door lock system in the given example further includes a plurality of door locks, each of which has a control device at a respective one of the door lock release locations. The cam is configured to engage a control device upon rotation of the cam at the respective one of the door lock release locations.

The actuator lock may be configured for use with a key for manually shifting the actuator lock between the open and closed conditions, and for manually rotating the shaft when the actuator lock is in the open condition. The selector may include a lead screw configured for use with a driving tool for manually rotating the lead screw.

DETAILED DESCRIPTION

Figure 2:
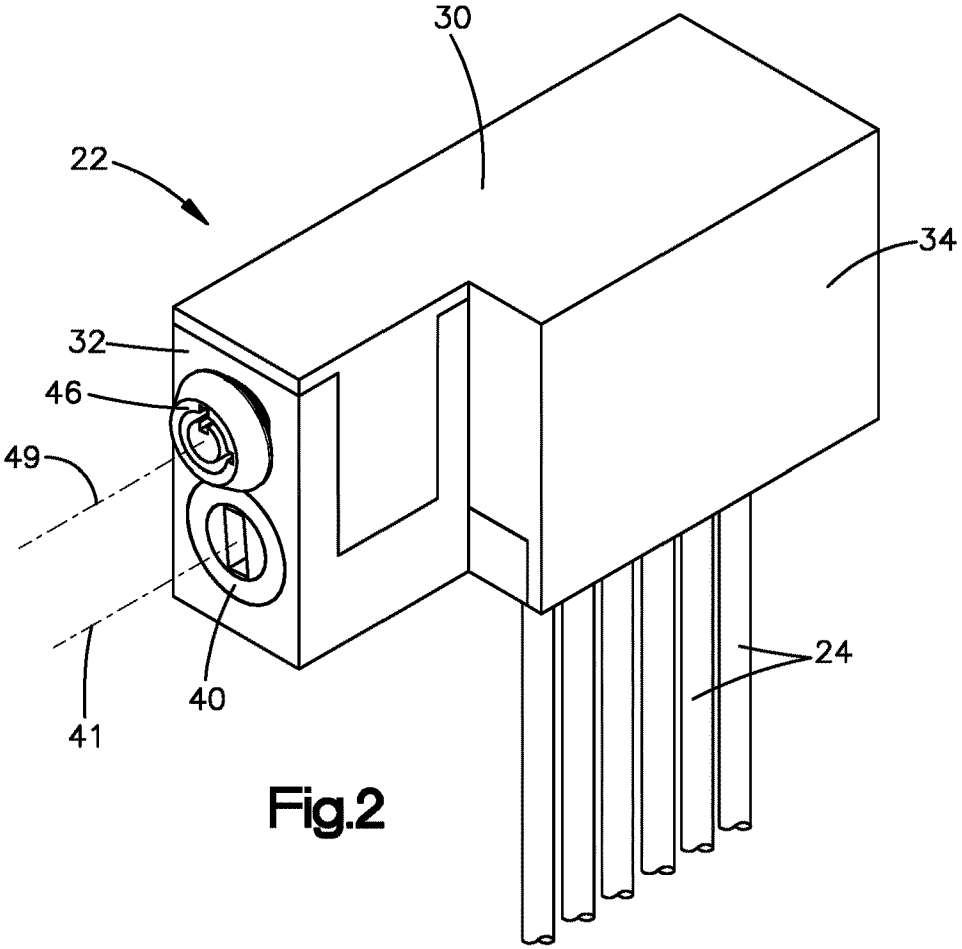
FIG. 2 is enlarged partial view of parts shown in FIG. 1, including the opening mechanism.

The apparatus shown in the drawings has parts that are examples of the elements recited in the claims. The illustrated apparatus thus includes examples of how a person of ordinary skill in the art can make and use the claimed invention. These examples provide enablement and best mode without imposing limitations that are not recited in the claims. One or more elements of one embodiment may be used in combination with, or in substitution for, one or more elements of another embodiment as needed for any particular implementation of the claimed invention.

Figure 1:
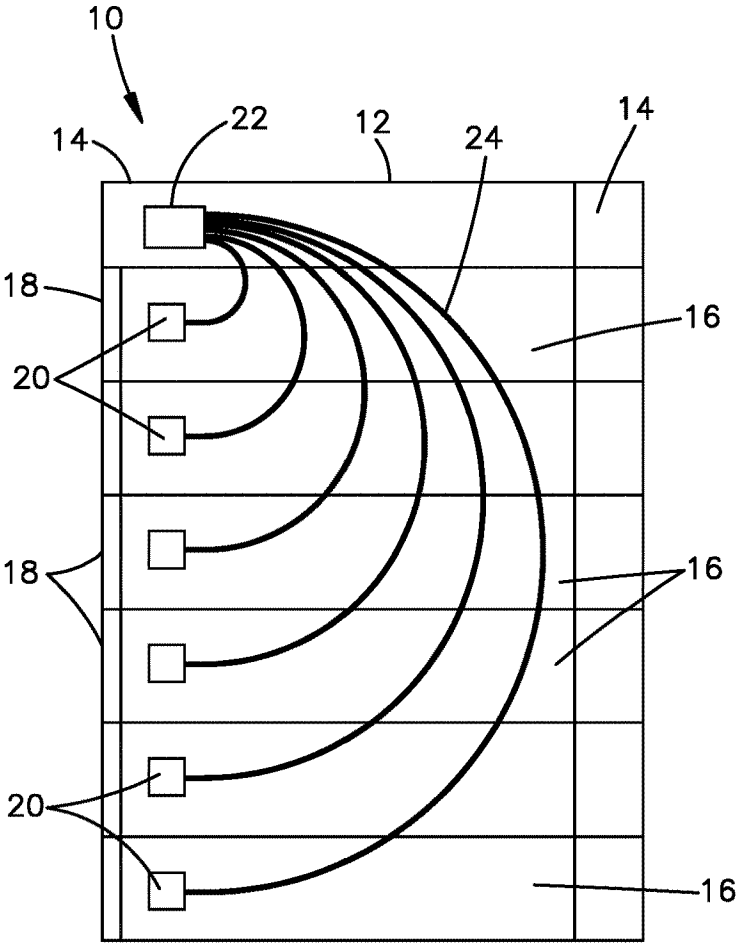
FIG. 1 is a schematic view of a cabinet with a vertical array of lockers and an opening mechanism for locks at the locker doors.

As shown schematically in FIG. 1, a locker cabinet 10 includes a frame 12 with corner channels 14. The cabinet 10 encloses a stack of storage lockers 16, each of which has a door 18 with a lock 20 mounted in an adjacent corner channel 14. An opening mechanism 22 also is mounted in a corner channel 14. Each door lock 20 has a respective control device 24 operatively connected with the opening mechanism 22.

As shown in FIG. 2, the opening mechanism 22 has a housing 30 with a front end 32 and a side portion 34. The control devices 24 in the given example are cables reaching downward from the side portion 34 of the housing 30. A selector 40 is supported in the housing 30 for rotation about a first axis 41, and is accessible at the front end 32 of the housing 30. An actuator 46 is supported in the housing 30 for rotation about a second axis 49 parallel to the first axis 41, and also is accessible at the front end 32 of the housing 30.

Figure 3:
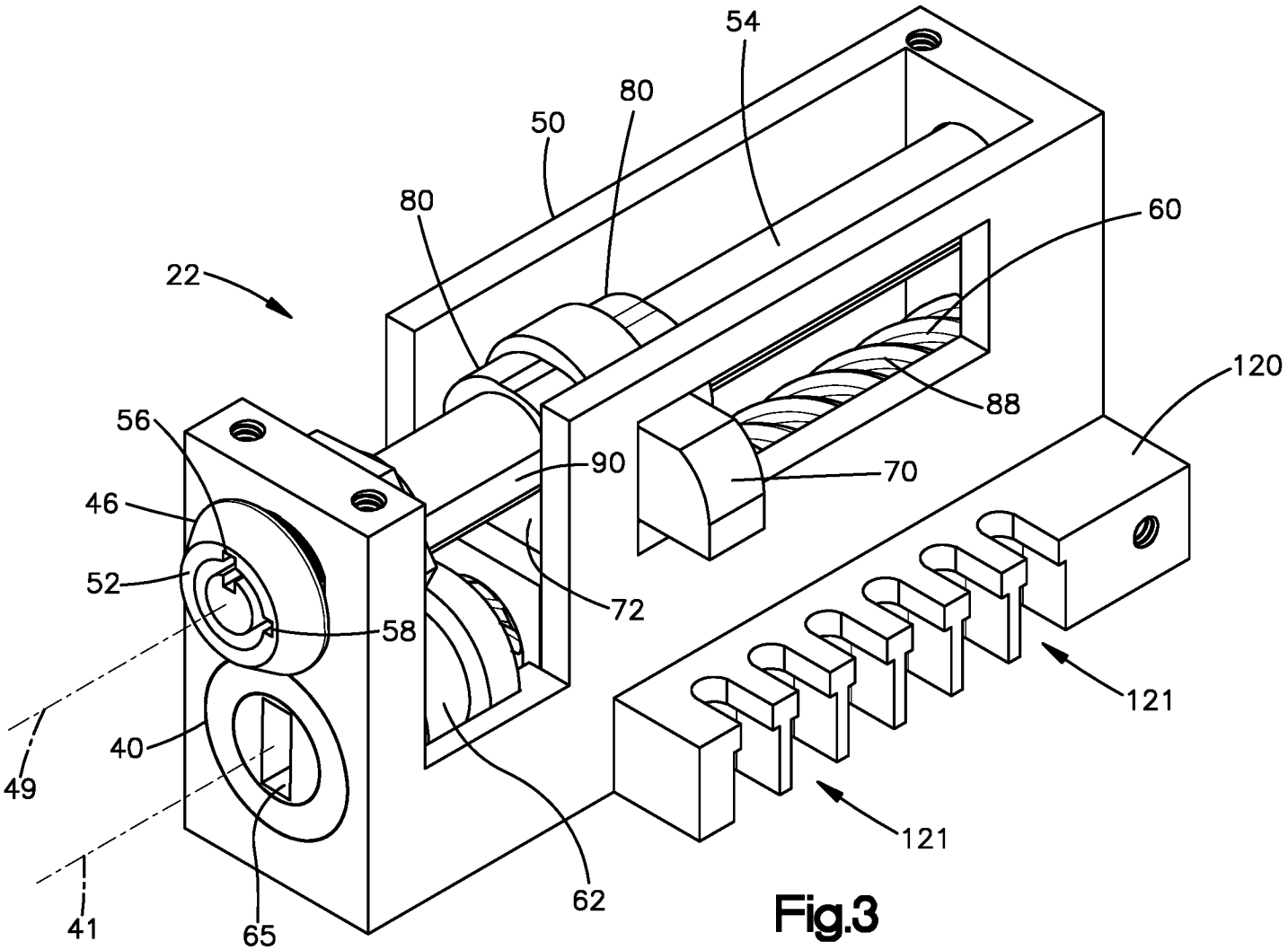
FIG. 3 is an isometric view of the opening mechanism of FIG. 2, with parts removed for clarity of illustration.

FIG. 3 shows that the housing 30 includes a frame 50. The actuator 46 is shown to include an actuator lock 52 and a shaft 54. The actuator lock 52 is configured to receive a key for rotation about the second axis 49 between first and second positions defined by first and second notches 56 and 58. Specifically, the actuator lock 52 is opened by insertion of the key in the first position 56. The actuator lock 52 can then be rotated clockwise toward the second position 58. The shaft 54 is supported on the frame 50 for rotation about the second axis 49 with the lock 52.

As further shown in FIG. 3, this example of the selector 40 is a lead screw 60 with a hub 62. The lead screw 60 has a slot 65 for insertion of a screwdriver or other manual driving tool to rotate the lead screw 60 about the first axis 41.

Figure 4:
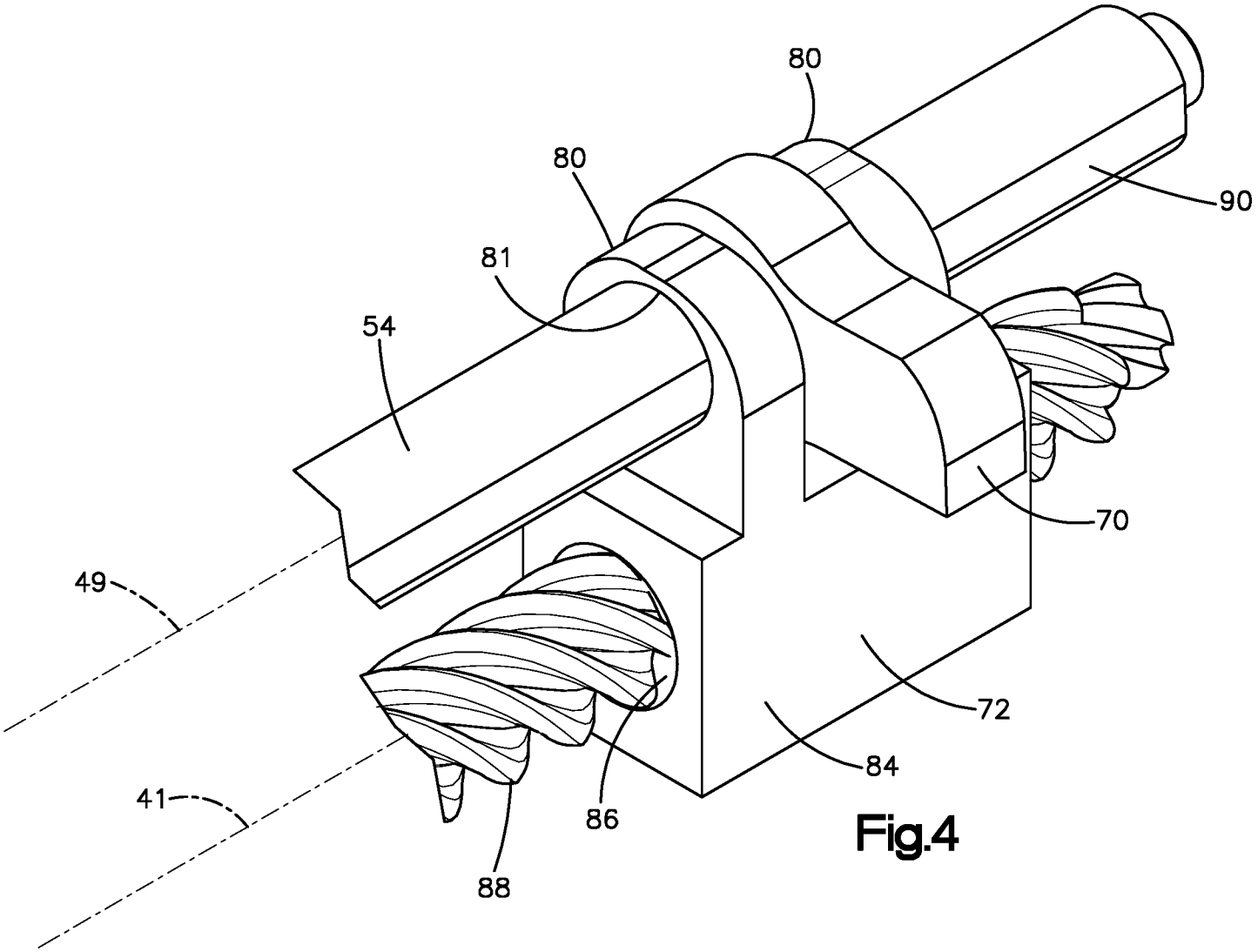
FIG. 4 is a separate view of several parts shown in FIG. 3.

Also shown in FIG. 3 are a cam 70 and a yoke 72. As best shown in FIG. 4, the yoke 72 has a pair of arms 80. The shaft 54 reaches through apertures 81 in the arms 80 such that the shaft 54 can rotate relative to the yoke 72, and the yoke 72 can move axially relative to the shaft 54. The yoke 72 further has a base 84 with an internal screw thread 86. The internal screw thread 86 on the yoke 72 mates with an external screw thread 88 on the lead screw 60. In this arrangement, rotation of the lead screw 60 about the first axis 41 drives the yoke 72 to move axially along both the lead screw 60 and the shaft 54.

The cam 70 is mounted on the shaft 54 with adjoining flats 90, one of which is shown in FIGS. 3 and 4, for the cam 70 to rotate about the second axis 49 with the shaft 54. The cam 70 can also move axially relative to the shaft 54, and is captured between the yoke arms 80 to slide axially along the shaft 54 with the yoke 72.

Figure 5:
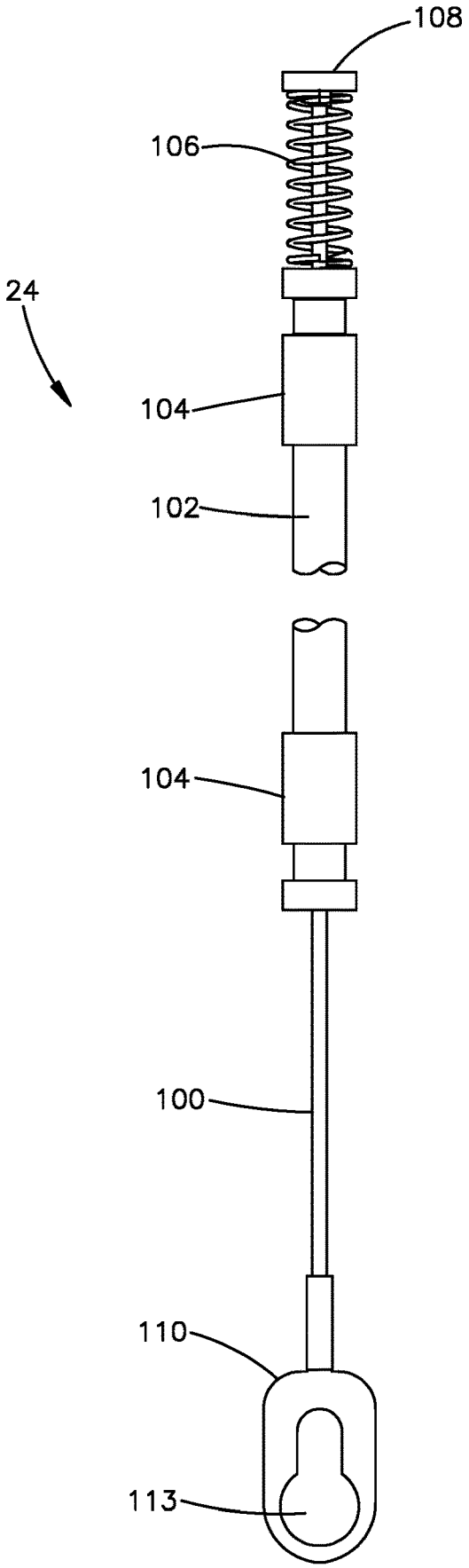
FIG. 5 is a separate view of a part shown in FIG. 2.

The control devices 24 (FIG. 2) in the given example are cable assemblies, one of which is shown in FIG. 5. Each cable assembly 24 includes a wire 100 that reaches through a sheath 102 and projects outward from anchors 104 at opposite end of the sheath 102. A spring 106 is compressible between the upper anchor 104 and a button 108 at the upper end of the wire 100. A tab 110 at the lower end of the wire 100 has a key hole slot 113 for receiving a tripping arm on one of the door locks 20 (FIG. 1). Such door locks 20 with tripping arms are known in the art.

Referring again to FIG. 3, the frame 50 has a shelf 120 with slots 121 arranged in a row alongside the lead screw 60. The slots 121 define respective door lock release locations that are spaced apart in a direction parallel to the first axis 41. Each slot 121 is configured to receive an anchor 104 at the upper end of a corresponding one of the cable assemblies 24 (FIG. 5). Each door lock 20 has a normally locked condition in which the spring 106 at the upper end of the corresponding cable assembly 24 holds the respective button 108 in an uppermost position above the shelf 120 on the frame 50.

With the cable assemblies 24 installed as shown in FIG. 2, a user can insert a driving tool into the slot 65 to rotate the lead screw 60 and thereby to move the cam 70 axially into a selected one of the door lock release locations 121 (FIG. 3). This moves the cam 70 into position above the button 108 (FIG. 5) on the cable assembly 24 at that location. The user can then insert the key into the actuator lock 52 in the first position 56 to open the actuator lock 52. Rotating the key and the actuator lock 52 in the clockwise direction toward the second position 58 likewise rotates the shaft 54 and the cam 70 in the clockwise direction. The cam 70 then pivots downward against the button 108 on the cable assembly 24 to push the button 108 downward against the bias of the respective spring 106. This shifts the wire 100 and the tab 110 downward to unlock the associated door lock 20. When the user rotates the key back to the first position 56, the spring 106 pulls the wire 100 and tab 110 back upward to return the door lock 20 to the locked condition.

This written description sets forth the best mode of carrying out the invention, and describes the invention so as to enable a person of ordinary skill in the art to make and use the invention, by presenting examples of the elements recited in the claims. The detailed descriptions of those elements do not impose limitations that are not recited in the claims.

What is claimed is:

1. A door lock system comprising:

a shaft supported for rotation;

a cam supported on the shaft for rotation with the shaft, and for movement along the shaft throughout a range of door lock release locations;

a selector engaged with the cam to move the cam along the shaft upon rotation of the selector; and an actuator lock having a closed condition blocking rotation of the shaft and an open condition permitting rotation of the shaft, whereby the actuator lock prevents rotation of the cam at any of the door lock release locations when the actuator lock is in the closed condition.

2. A door lock system as defined in claim 1, further comprising a plurality of door locks, each of which has a control device at a respective one of the door lock release locations, wherein the cam is configured to engage a control device upon rotation of the cam at the respective one of the door lock release locations.

3. A door lock system as defined in claim 2, wherein each control device comprises a cable assembly configured to reach from the respective door lock to the respective door lock release location.

4. A door lock system as defined in claim 1, wherein the actuator lock is configured for use with a key for manually shifting the actuator lock between the open and closed conditions, and for manually rotating the shaft when the actuator lock is in the open condition.

5. A door lock system as defined in claim 4, wherein the selector comprises a lead screw configured for use with a driving tool for manually rotating the lead screw.

6. A door lock system as defined in claim 1, further comprising a frame, wherein the selector is supported on the frame for rotation about a first axis relative to the frame, and the shaft is supported on the frame for rotation about a second axis relative to the frame.

7. A door lock system as defined in claim 6, wherein the actuator lock is supported on the frame at an axially outer end of the shaft.

8. A door lock system as defined in claim 6, wherein the first axis is parallel to the second axis.

9. A door lock system as defined in claim 6, wherein the selector comprises a lead screw.

10. A door lock system comprising:

a shaft supported for rotation;

a cam supported on the shaft for rotation with the shaft, and for movement along the shaft throughout a range of door lock release locations;

an actuator lock having a closed condition blocking rotation of the shaft and an open condition permitting rotation of the shaft, whereby the actuator lock prevents rotation of the cam at any of the door lock release locations when the actuator lock is in the closed condition; and a plurality of door locks, each of which has a respective control device configured to engage the cam at a respective one of the predetermined door lock release locations upon rotation of the cam with the shaft.

11. A door lock system as defined in claim 10, wherein each control device comprises a cable assembly configured to reach from the respective door lock to the respective door lock release location.

12. A door lock system as defined in claim 10, further comprising a frame, wherein the shaft is supported on the frame for rotation about an axis relative to the frame, and the actuator lock is supported on the frame at an axially outer end of the shaft.

13. A door lock system as defined in claim 10, wherein the actuator lock is configured for use with a key for manually shifting the actuator lock between the open and closed conditions, and for manually rotating the shaft when the actuator lock is in the open condition.

14. A door lock system comprising:

a frame;

a shaft supported on the frame for rotation relative to the frame;

a cam supported on the shaft for rotation with the shaft relative to the frame, and for movement along the shaft throughout a range of door lock release locations;

a selector supported on the frame for rotation relative to the frame, wherein the selector engages the cam to move the cam along the shaft upon rotation of the selector; and an actuator lock supported on the frame at an axially outer end of the shaft;

wherein the actuator lock has an open condition permitting rotation of the shaft and a closed condition preventing rotation of the shaft; and the actuator lock is configured for use with a key for manually shifting the actuator lock between the open and closed conditions, and for manually rotating the shaft when the actuator lock is in the open condition.

15. A door lock system as defined in claim 14, wherein the selector is configured for use with a driving tool for manually rotating the lead screw.

16. A door lock system as defined in claim 14, wherein the shaft is supported on the frame for rotation about a first axis relative to the frame, and the selector is supported on the frame for rotation about a second axis relative to the frame.

17. A door lock system as defined in claim 16, wherein the first axis is parallel to the second axis.

18. A door lock system as defined in claim 14, wherein the selector comprises a lead screw.

19. A door lock system as defined in claim 14, further comprising a plurality of door locks, each of which has a respective control device configured for engagement with the cam at a respective one of the predetermined lock release locations upon rotation of the cam with the shaft.

20. A door lock system as defined in claim 19, wherein each control device comprises a cable assembly configured to reach from the respective door lock to the frame.

* * * * *